US008210452B2

(12) United States Patent
Larson et al.

(10) Patent No.: US 8,210,452 B2
(45) Date of Patent: Jul. 3, 2012

(54) DEVICE FOR INTRODUCING CATALYST INTO ATOMIZED COATING COMPOSITION

(75) Inventors: John Charles Larson, West Chester, PA (US); Alan Arthur Burmester, Rice Lane, WI (US)

(73) Assignee: E I du Pont de Nemours and Company, Wilmington, DE (US)

( * ) Notice: Subject to any disclaimer, the term of this patent is extended or adjusted under 35 U.S.C. 154(b) by 280 days.

(21) Appl. No.: 12/808,540

(22) PCT Filed: Dec. 23, 2008

(86) PCT No.: PCT/US2008/088085

§ 371 (c)(1), (2), (4) Date: Jun. 16, 2010

(87) PCT Pub. No.: WO2009/086336

PCT Pub. Date: Jul. 9, 2009

(65) Prior Publication Data

US 2010/0276516 A1 Nov. 4, 2010

Related U.S. Application Data

(60) Provisional application No. 61/009,313, filed on Dec. 27, 2007.

(51) Int. Cl.
*A62C 5/00* (2006.01)

(52) U.S. Cl. ..... 239/311; 239/424

(58) Field of Classification Search ..... 239/310, 239/311, 344, 337, 290, 291, 398, 406, 433, 239/421, 424

See application file for complete search history.

(56) References Cited

U.S. PATENT DOCUMENTS

| | | | | | |
|---|---|---|---|---|---|
| 3,412,937 | A * | 11/1968 | Chamberlain | ..... | 239/142 |
| 4,824,017 | A | 4/1989 | Mansfield | | |
| 4,854,504 | A * | 8/1989 | Hedger et al. | ..... | 239/294 |
| 5,152,460 | A * | 10/1992 | Barty | ..... | 239/290 |
| 5,322,221 | A * | 6/1994 | Anderson | ..... | 239/291 |
| 6,087,413 | A | 7/2000 | Lake | | |
| 6,267,301 | B1 * | 7/2001 | Haruch | ..... | 239/290 |
| 7,201,289 | B2 | 4/2007 | Bhatia | | |
| 2007/0194146 | A1 * | 8/2007 | Dorendorf | ..... | 239/419.3 |

FOREIGN PATENT DOCUMENTS

| | | | |
|---|---|---|---|
| DE | 1009071 | B | 5/1957 |
| DE | 1063496 | B | 8/1959 |
| WO | 98/47626 | A | 10/1998 |
| WO | 03/053600 | A | 7/2003 |
| WO | 2005/092934 | | 10/2005 |

* cited by examiner

*Primary Examiner* — Davis Hwu
(74) *Attorney, Agent, or Firm* — Gann G. Xu

(57) ABSTRACT

The present invention is directed to a delivery device and a system for introducing the catalyst into the atomized coating composition. This invention is also directed to a system for producing a mixed composition comprising two or more components.

7 Claims, 10 Drawing Sheets

DEVICE FOR INTRODUCING CATALYST INTO ATOMIZED COATING COMPOSITION

CROSS-REFERENCE TO RELATED APPLICATION

This application claims priority from U.S. Provisional Application Ser. No. 61/009,313 (filed Dec. 27, 2007), the disclosure of which is incorporated by reference herein for all purposes as if fully set forth.

FIELD OF INVENTION

This invention is directed to a delivery device and a system for introducing the catalyst into the atomized coating composition. This invention is also directed to a system for producing a mixed composition comprising two or more components.

BACKGROUND OF INVENTION

Automobile coatings typically comprise crosslinked polymer network formed by multiple reactive components. The coatings are typically sprayed onto a substrate such as the body or body parts of an automobile vehicle using a spray device and then cured to form a coating layer having such crosslinked polymer network.

In the spraying technology practiced currently in refinish shops, multiple reactive components of a coating composition are mixed to form a pot mix prior to spraying and placed in a cup-like reservoir that is attached to a hand-held spraying device such as a spray gun. Due to the reactive nature of the multiple reactive components, the pot mix will start to react as soon as they are mixed together causing continued increase in viscosity of the pot mix. Once the viscosity reaches a certain point, the pot mix becomes practically un-sprayable. The possibility that the spray gun itself may become clogged with crosslinked polymer materials is also disadvantageous. The time it takes for the viscosity to increase to such point where spraying becomes ineffective, generally up to a two-fold increase in viscosity, is referred to as "pot life".

One way to extend "pot life" is to add a greater amount of thinning solvent to the pot mix. However, thinning agents contribute to increased emissions of volatile organic compounds (VOC) and also increase the curing time.

Other attempts to extend "pot life" of a pot mix of a coating composition have focused on "chemical-based" solutions. For example, it has been suggested to include modifications of one or more of the reactive components or certain additives that would retard polymerization reaction of the multiple components in the pot mix. The modifications or additives must be such that the rate of curing is not adversely affected after the coating is applied to the surface of a substrate.

Another approach is to mix one or more key components, such as a catalyst, together with other components of the coating composition immediately prior to spraying. One example is described in U.S. Pat. No. 7,201,289 in that a catalyst solution is stored in a separate dispenser and being dispensed and mixed with a liquid coating formulation before the coating formulation is atomized.

Yet another approach is to separately atomize two components, such as a catalyst and a resin, of a coating composition, and mix the two atomized components after spray. One such example is described in U.S. Pat. No. 4,824,017. However, such approach requires atomization of two components separately by using separate pumps and injection means for each of the two components.

There is still a need for a method and system to improve pot life of a coating composition and to reduce VOC.

STATEMENT OF INVENTION

This invention is directed to a system for producing a layer of a coating composition on a substrate, said system comprising:

(A) a spray gun for producing a stream of atomized first coating component of said coating composition through an orifice of said spray gun, said spray gun comprises a spray gun body (1), one or more inlets, a nozzle assembly including an orifice (13) and an air cap (24); and (B) a delivery device for delivering at least one additional coating component into the stream of atomized said first coating component, said delivery device comprises:

(a) at least one delivery outlet (14);

(b) at least one intake coupling (8); and (c) at least one connection path (11) connecting said intake coupling and said delivery outlet;

wherein said additional coating component is siphoned by said stream of atomized said first coating component from said delivery outlet;

wherein said delivery outlet is coupled through said connection path and said intake coupling to a storage container (4) containing said additional component; and wherein said delivery outlet being transversely positioned at said orifice and having an end opening outline that dimensionally matches said orifice.

This invention is directed to a system for producing a mixed composition comprising two or more components, said system comprising:

(A) a spray device for producing a stream of atomized first component of said mixture composition through an orifice of said spray device; and (B) a delivery device for delivering one or more additional components of said mixed composition into the stream of atomized said first component, said delivery device comprises:

(a) at least one delivery outlet (14);

(b) at least one intake coupling (8); and (c) at least one connection path (11) connecting said intake coupling and said delivery outlet;

wherein said one or more additional components are siphoned by said stream of atomized said first component from said delivery outlet;

wherein said at least one delivery outlet is coupled through said connection path and said intake coupling to one or more storage containers (4) containing said one or more additional components; and wherein said delivery outlet being transversely positioned at said orifice and having an end opening outline that dimensionally matches said orifice.

DETAILED DESCRIPTION

Figure 1:
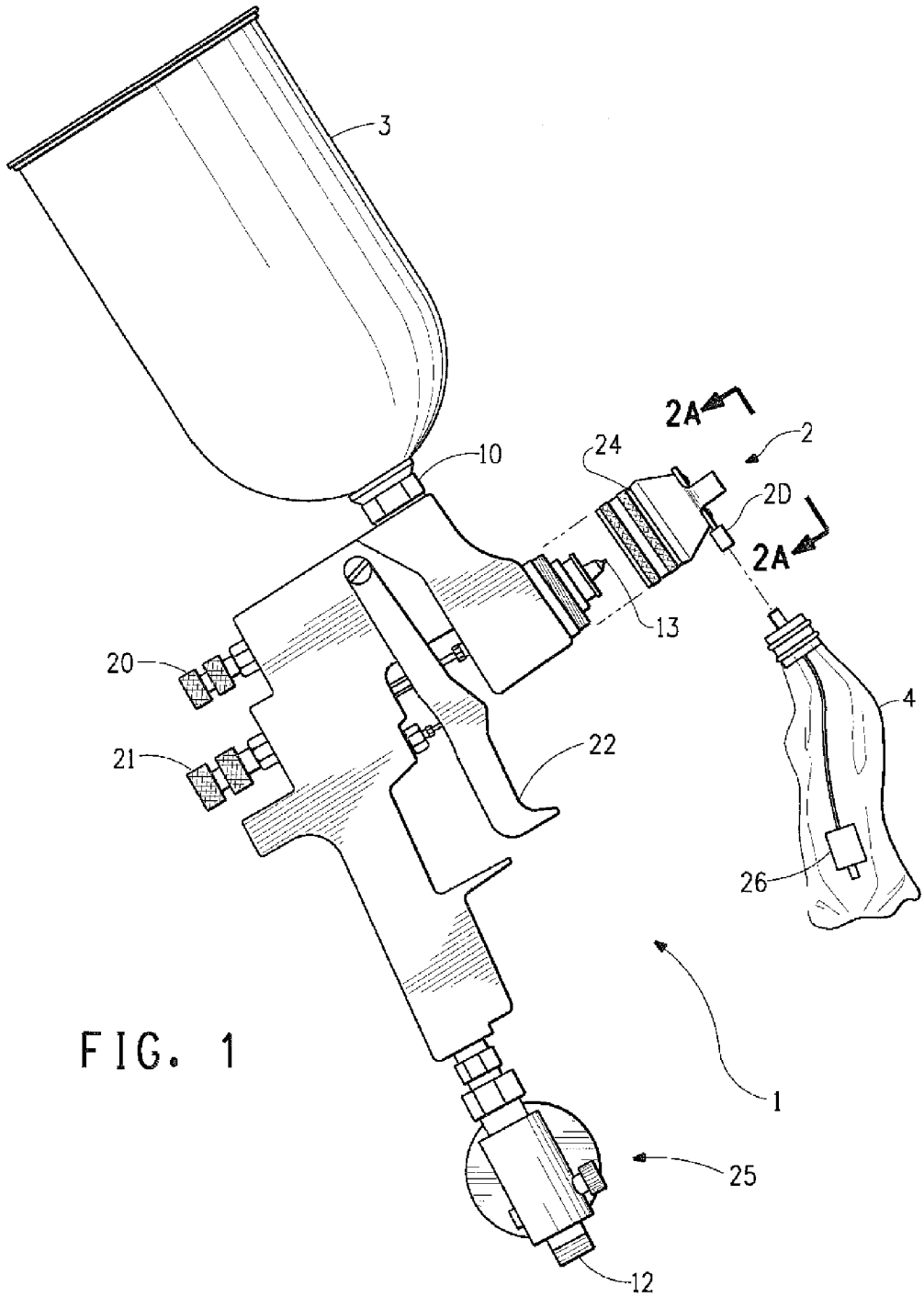
FIG. 1 shows a spray gun affixed with an example of a representative delivery device of this invention.

The features and advantages of the present invention will be more readily understood, by those of ordinary skill in the art, from reading the following detailed description. It is to be appreciated that certain features of the invention, which are, for clarity, described above and below in the context of separate embodiments, may also be provided in combination in a single embodiment. Conversely, various features of the invention that are, for brevity, described in the context of a single embodiment, may also be provided separately or in any sub-combination. In addition, references in the singular may also include the plural (for example, "a" and "an" may refer to one, or one or more) unless the context specifically states otherwise.

The use of numerical values in the various ranges specified in this application, unless expressly indicated otherwise, are stated as approximations as though the minimum and maximum values within the stated ranges were both proceeded by the word "about." In this manner, slight variations above and below the stated ranges can be used to achieve substantially the same results as values within the ranges. Also, the disclosure of these ranges is intended as a continuous range including every value between the minimum and maximum values.

As used herein:

"Two-pack coating composition" means a thermoset coating composition comprising two components that are stored in separate containers, which are typically sealed for increasing the shelf life of the components of the coating composition. The components are mixed just prior to use to form a pot mix, which has a limited pot life, typically few minutes, such as 15 minutes to 45 minutes to few hours, such as 4 hours to 10 hours. The pot mix is applied as a layer of desired thickness on a substrate surface, such as the body or body parts of a vehicle. After application, the layer dries and cures to form a coating on the substrate surface having desired coating properties, such as, high gloss, mar-resistance, resistance to environmental etching and resistance to degradation by solvent. A typical two-pack coating composition comprises a crosslinkable component and a crosslinking component.

"Low VOC coating composition" means a coating composition that includes less than 0.6 kilograms per liter (5 pounds per gallon), preferably less than 0.52 kilograms (4.3 pounds per gallon), even preferably less than 0.42 kilograms (3.5 pounds per gallon) of volatile organic component, such as certain organic solvents. The phrase "volatile organic component" is herein referred to as VOC. VOC level is determined under the procedure provided in ASTM D3960.

"Crosslinkable component" includes a compound, oligomer, or polymer having crosslinkable functional groups positioned in each molecule of the compound, oligomer, the backbone of the polymer, pendant from the backbone of the polymer, terminally positioned on the backbone of the polymer, or a combination thereof. One of ordinary skill in the art would recognize that certain crosslinkable group combinations would be excluded from the crosslinkable component of the present invention, since, if present, these combinations would crosslink among themselves (self-crosslink), thereby destroying their ability to crosslink with the crosslinking groups in the crosslinking components defined below.

Typical crosslinkable component can have on an average 2 to 25, preferably 2 to 15, more preferably 2 to 10, even more preferably 3 to 7, crosslinkable groups selected from hydroxyl, thiol, acetoacetoxy, carboxyl, primary amine, secondary amine, epoxy, anhydride, imino, ketimine, aldimine, silane, or a combination thereof.

"Crosslinking component" is a component that includes a compound, oligomer, or polymer having crosslinking functional groups positioned in each molecule of the compound, oligomer, the backbone of the polymer, pendant from the backbone of the polymer, terminally positioned on the backbone of the polymer, or a combination thereof, wherein these functional groups are capable of crosslinking with the crosslinkable functional groups on the crosslinkable component (during the curing step) to produce a coating in the form of crosslinked structures. One of ordinary skill in the art would recognize that certain crosslinking group/crosslinkable group combinations would be excluded from the present invention, since they would fail to crosslink and produce the film forming crosslinked structures.

Typical crosslinking component can be selected from a compound, oligomer, or polymer having crosslinking functional groups selected from the group consisting of isocyanate, amine, ketimine, melamine, epoxy, carboxylic acid, anhydride, and a combination thereof. It would be clear to one of ordinary skill in the art that generally certain crosslinking groups from crosslinking components crosslink with certain crosslinkable groups from the crosslinkable components. Some of those paired combinations include: (1) ketimine crosslinking groups generally crosslink with acetoacetoxy, epoxy, or anhydride crosslinkable groups; (2) isocyanate and melamine crosslinking groups generally crosslink with hydroxyl, thiol, primary and secondary amine, ketimine, or aldimine crosslinkable groups; (3) epoxy crosslinking groups generally crosslink with carboxyl, primary and secondary amine, ketimine, or anhydride crosslinkable groups; (4) amine crosslinking groups generally crosslink with acetoacetoxy crosslinkable groups; (5) carboxylic acid crosslinking groups generally crosslink with epoxy crosslinkable groups; and (6) anhydride crosslinking groups generally crosslink with epoxy and ketimine crosslinkable groups.

"One-Pack coating composition", also known as 1K coating composition, means a coating composition comprises multiple ingredients mixed in one single package. A one-pack coating composition can form a coating layer under certain conditions. An example of 1K coating composition comprises one or more components having acrylic double bonds that can be cured by ultraviolet (UV) radiation in which the double bonds of the acrylic groups undergo polymerization to form crosslinked network. U.S. Pat. No. 6,087,413, for example, discloses a 1K UV curable clearcoat composition that can be completely cured by UV radiation to form a dry coating. A UV curable coating composition can usually have indefinite pot life until being sprayed and irradiated with UV light. Upon UV radiation, the UV curable coating can be cured to form a dry coating in very short period of time, typically within a few minutes. One or more photo initiators are typically required for curing such UV curable coating composition.

A coating composition may include a catalyst, an initiator, an activator, a curing agent, or a combination thereof.

A catalyst can initiate or promote the reaction between reactants, such as between crosslinkable functional groups of a crosslinkable component and crosslinking functional groups of a crosslinking component of a coating composition. The amount of the catalyst depends upon the reactivity of functional groups, such as the crosslinkable and the crosslinking functional groups, of the coating composition. Generally, in the range of from about 0.001 percent to about 5 percent, preferably in the range of from 0.01 percent to 2 percent, more preferably in the range of from 0.02 percent to 1 percent, all in weight percent based on the total weight of the crosslinkable component solids, of the catalyst is utilized. A wide variety of catalysts can be used, such as, tin compounds, including dibutyl tin dilaurate; or tertiary amines, such as, triethylenediamine. These catalysts can be used alone or in conjunction with carboxylic acids, such as, acetic acid. One example of commercially available catalysts is dibutyl tin dilaurate as Fascat® series sold by Arkema, Bristol, Pa., under respective trademark.

An activator can activate one or more components of a coating composition. For example, water can be an activator for a coating described in PCT publication WO2005/092934, published on Oct. 6, 2005, wherein water activates hydroxyl groups by hydrolyzing orthoformate groups that block the hydroxyl groups from reacting with crosslinking functional groups.

An initiator can initiate one or more reactions. An example is photo initiators and/or sensitizers that cause photopolymerization or curing of a radiation curable coating composition upon radiation, such as the aforementioned UV curable coating composition. As known to those skilled in the art, many photo initiators can be suitable for the invention. These include, but not limited to, benzophenone, benzion, benzion-methyl ether, benzion-n-butyl ether, benzion-iso-butyl ether, propiophenone, acetophenone, methyphenylgloxylate, 1-hydroxycyclohexyl phenyl ketone, 2, 2-diethoxyacetophenone, ethylphenylpyloxylate, diphenyl (2,4,6-trimethylbenzoyl)-phosphine oxide, phosphine oxide, phenyl bis (2,4,6-trimethyl benzoyl), phenanthraquinone, and a combination thereof. Other commercial photo initiator products, or a combination thereof, such as Darocure® 1173, Darocure® MBF, Darocure®TPO or Irgacure® 184, Irgacure® 4265, Irgacure® 819, Irgacure® 2022 or Irgacure® 2100 from Ciba Co., are also suitable. Darocure® and Irgacure® are registered trademarks of Ciba Specialty Chemicals Corporation, New York.

A curing agent can react with other components of a coating composition to cure the coating composition into a coating. For example, a crosslinking component, such as isocyanates, can be a curing agent for a coating comprising a crosslinkable hydroxyl component. On the other hand, a crosslinkable component can be a curing agent for a crosslinking component.

In conventional coating practice, components of a two-pack coating composition are mixed immediately prior to spraying to form a pot mix which has a limited pot life, wherein said components can include a crosslinking component, a crosslinkable component, necessary catalysts, and other components necessary as determined by those skilled in the art. In addition to the limited pot life, many catalysts can change its activity in the pot mix. For example, some catalysts can be sensitive to the trace amount of water in the pot mix since water can cause hydrolysis and hence inactivate the catalyst.

One prior approach is to mix the catalyst with other components of the coating composition immediately prior to spraying. One example is described in aforementioned U.S. Pat. No. 7,201,289 in that a catalyst solution is stored in a separate dispenser and being dispensed and mixed with a liquid coating formulation before the coating formulation is atomized. However, this approach requires mixing the catalyst and the liquid coating composition prior to atomization.

Another example of prior approach is described in U.S. Pat. No. 4,824,017 in that a catalyst and a resin of a coating composition are separately atomized and mixed after atomization. However, such approach requires atomization of two components separately by using separate pumps and individual injection means for each of the two components. This approach also requires intensive adjustment and monitoring of the individual atomization and injection to ensure constant mixing ratio of the two components.

This invention is directed to a method for producing a layer of a coating composition on a substrate and comprises the following steps.

Step (A), a first coating component of a coating composition can be conveyed through a first inlet (10) of a spray gun (1) to an orifice (13) of said spray gun to produce a stream of atomized said first coating component.

Step (B), a second coating component of said coating composition can be siphoned into the stream of atomized said first coating component to form a coating mixture, wherein said second coating component is siphoned by said stream of atomized said first coating component from at least one delivery outlet (14) coupled to a storage container (4) containing said second coating component, said delivery outlet (14) being transversely positioned at said orifice (13).

Step (C), the coating mixture can be applied on the substrate to form the layer of said coating composition thereon.

Any spray gun that can produce a stream of atomized coating composition can be suitable for this invention. A gravity feed spray gun is preferred. A gravity feed spray gun using compressed air as an atomization carrier is further preferred. Typically, a spray gun comprises a spray gun body (1), a nozzle assembly (2) including an orifice (13) and an air cap (24), a carrier coupling (12) for coupling to a source of a carrier, such as compressed air, an air regulator assembly (25) for regulating flow rate and pressure of the carrier, a coating flow regulator (21) for regulating the flow of the first coating component that is stored in a main reservoir (3), and an inlet (10) coupling the spray gun (1) to the main reservoir (3). The spray gun typically also includes additional controls such as a trigger (22) and a spray fan regulator (20) for regulating compressed air jetting out from a set of air jets (13A, FIGS. 2A and 2B) forming desired spray shape, such as fan-shape. In a typical gravity feed spray gun, the first coating component is typically not pressurized and stored in a storage container, such as the main reservoir (3) which is at atmosphere pressure.

The pressurized carrier can be selected from compressed air, compressed gas, compressed gas mixture, or a combination thereof. Typically, the pressurized carrier is compressed air. Compressed gas, such as compressed nitrogen, compressed carbon dioxide, compressed fluorocarbon, or a mixture thereof, can also be used. The compressed carrier can also include gases produced from compressed liquids, solids, or reactions from liquids or solids.

In this invention, the second coating component can be at atmosphere pressure. It is preferred that the second coating component is in liquid form. It is preferred that the second coating component interacts with the first coating component to form a coating on the substrate. It is further preferred that the second coating component is selected from a catalyst, an initiator, an activator, a curing agent, or a combination thereof. In one example, the second coating component is a catalyst, such as dibutyl tin dilaurate; or tertiary amines, such as, triethylenediamine. In another example, the first coating component comprises a crosslinkable component and the second coating component comprises a curing agent such as a crosslinking component. In yet another example, the first coating component is a UV curable coating composition lacking one or more photo initiators and the second coating component comprises the one or more photo initiators. In yet another example, the second coating component comprises one or more activators, such as an acid or water that can activate the first coating composition to form a coating.

One advantage of this invention is that said atomized first coating component and said second coating component can be mixed at a pre-determined mixing ratio to form said coating mixture without the need for complex controls such as those described in aforementioned U.S. Pat. No. 4,824,017. The pre-determined mixing ratio can be determined by modulating the size of the delivery outlet (14), providing a flow rate controller functionally coupled to said delivery outlet, or a combination thereof.

The mixing ratio can be determined by selecting different sizes of the diameter of the delivery outlet. Coating mixtures formed by using different sizes of the outlets can be sprayed onto suitable substrates. Properties of the coating layers formed thereon can be measured. Based on the property measurement, s suitable size or a range of suitable sizes of the delivery outlets can be selected.

A flow rate controller, such as a valve or a commercial inline flow controller can be coupled to the delivery outlet to adjust the flow of the second coating component therefore affecting mixing ratio. A flow rate controller can also ne a small insert that is placed inside a connection path or a tubing connected to a connection path that is coupled to the delivery outlet. Such an insert can effectively reduce the size of the connection path or the tubing therefore reduces the flow of the second coating component.

Selection of sizes and the use of flow rate controller can be combined. For example, a size within a suitable range of the delivery outlet can be selected and a valve can be coupled to the delivery outlet so the mixing ratio can be fine tuned. Any flow rate controller that can be coupled to the delivery outlet can be suitable for this invention.

The storage container (4) containing the second coating component can be a flexible container, such as a plastic bag; a fixed-shape container, such as a canister made of metal or hard plastic; or a flexible inner container inside a fixed-shape container, such as a flexible plastic bag placed inside a fixed-shape metal container. A flexible container that can be collapsed easily is preferred. The flexible container can be a collapsible liner that can be sealed and used directly or be placed inside a fixed shape container. The storage container can be transparent or have a transparent window so the level of the content in the container can be readily visible. The storage container can have an indicator to indicate the level of the contents in the container. The storage container can be disposable or reusable. The storage container can be coupled to an intake coupling (8) which is connected to the delivery outlet (14) through a connection path (11). The storage container can be coupled to the intake coupling (8) via conventional means, such as a clip, a clamp, a set of matching screw tracks, or a plug-in. In one example, the storage container comprises a tube that can be plugged into the intake coupling (8). In another example, the storage container is screwed onto the intake coupling (8) via matching screw tracks. In yet another example, the storage container is plugged into the intake coupling (8) and secured by an additional fastener. The storage container can further have a unidirectional flow limiter (26) to eliminate back flow, wherein said unidirectional flow limiter can only allow the content to flow in one direction, such as only from the container to the delivery outlet.

Any back flow can be stopped by the directional flow limiter to avoid potential contamination. For a fixed-shape container, ventilation can be provided so the contents in the container can be maintained at atmosphere pressure.

This invention can further comprise the step of curing the layer of the coating composition on the substrate to form a coating thereon. This curing step can depend upon the coating composition used. The curing can be at ambient temperature, such as a temperature in a range of from 10° C. to 35° C.; or elevated temperatures, such as a temperature in a range of from 35° C. to 180° C., or higher. The curing can also be done by exposing the coating layer to radiation, such as UV light or electron beam, when the coating composition is radiation curable.

In this invention, the coating can be a primer, a basecoat, a pigmented basecoat, or a clearcoat. The substrate can be any surface that is coated with the coating composition. The substrate can be a vehicle, vehicle body, or vehicle body parts.

This invention can also be directed to a coating layer and a coated substrate produced by the method of this invention.

This invention can further comprise the step of siphoning a third or a subsequent coating component into the coating mixture, wherein the subsequent coating component is siphoned by said stream of atomized said first coating component. The second, the third or the subsequent coating component can be siphoned from the same or separate delivery outlets. The third coating component can be siphoned from the same delivery outlet that is also delivering the second coating component. The third or the subsequent coating component can also be siphoned from at least one subsequent delivery outlet. The at least one subsequent delivery outlet can be transversely positioned at the orifice of the spray gun.

The first, the second, the third or the subsequent coating components can interact to form the coating layer on the substrate. The second and the third coating component can be siphoned from separate individual storage containers and delivered from the same delivery outlet or separate delivery outlet.

A system can be used for producing a layer of a coating composition on a substrate using the method of this invention. The system can comprise:

(A) a spray gun for producing a stream of atomized first coating component of said coating composition through an orifice of said spray gun, said spray gun comprises a spray gun body (1), one or more inlets, a nozzle assembly including an orifice (13) and an air cap (24); and (B) a delivery device for delivering at least one additional coating component into the stream of atomized said first coating component, said delivery device comprises:

(a) at least one delivery outlet (14);

(b) at least one intake coupling (8); and (c) at least one connection path (11) connecting said intake coupling and said delivery outlet;

wherein said additional coating component is siphoned by said stream of atomized said first coating component from said delivery outlet; wherein said delivery outlet is coupled through said connection path and said intake coupling to a storage container (4) containing said additional coating component; and wherein said delivery outlet being transversely positioned at said orifice and having an end opening outline that dimensionally matches said orifice.

Figure 2A:
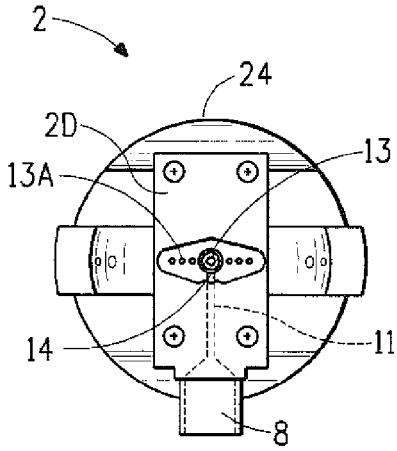
FIG. 2 shows a frontal view of the delivery device affixed to an air cap of a spray gun. (A) A schematic presentation of a representative example of the delivery device constructed as an add-on device. (B) A schematic presentation of a representative example of the delivery device constructed into the air cap of the spray gun.
Figure 2B:
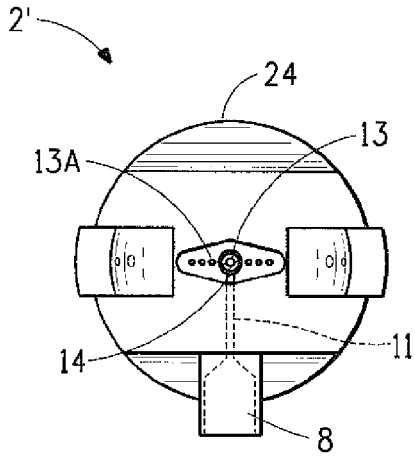

The delivery outlet (14), the intake coupling (8), and the connection path (11) can be constructed as an add-on device that can be affixed to the air cap (24) of the spray gun. The add-on device can be affixed to the air cap using conventional means such as one or more screws, clips, clamps, adhesives, latches, or a combination thereof. A representative example (2D) is shown in FIG. 2A. The delivery outlet (14), the intake coupling (8), and the connection path (11) can also be constructed into the air cap of said spray gun. A representative example (2') is shown in FIG. 2B. The views in FIG. 2 represent the frontal view 2A shown in FIG. 1. Although only one intake coupling (8) and one connection path (11) are shown in each of the Figures, those skilled in the art can make different configurations so two or more intake couplings, two or more connection paths, two or more delivery outlets, or a combination thereof, can be used based on the descriptions of this invention disclosed herein.

Figure 3:
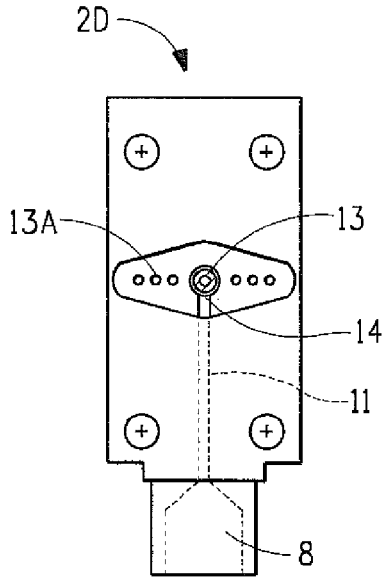
FIG. 3 shows an enlarged frontal view, in a schematic presentation, of a representative example of the delivery device constructed as an add-on device that can be affixed to an air cap of a spray gun. The air jets (13A) and orifice (13) are shown in the figure to indicate relative position of the delivery device when affixed to the air cap. The air jets (13A) and orifice (13) are part of the spray gun.
Figure 4:
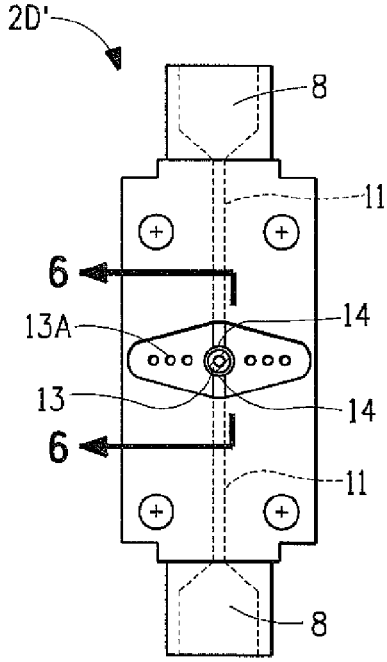
FIG. 4 shows an enlarged frontal view, in a schematic presentation, of another representative example of the delivery device constructed as an add-on device that can be affixed to an air cap of a spray gun. The air jets (13A) and orifice (13) are shown in the figure to indicate relative position of the delivery device when affixed to the air cap. The air jets (13A) and orifice (13) are part of the spray gun.

Representative configurations of the add-on device (2D, 2D', 2D" and 2D"') are shown in FIGS. 3, 4 and 10. The system can have a single delivery outlet (14), such as shown in FIG. 3, or two or more delivery outlets (14) as shown in FIG. 4. There can be one or more connection paths (11) as indicated in FIGS. 3 and 4. The add-on device (2D) is shown in configurations that are suitable for use with a representative nozzle assembly (2) and the air cap (24). Based on descriptions disclosed herein, those skilled in the art can make modifications and re-configurations so the add-on device can be used with other spray guns, nozzle assemblies, air caps, or a combination thereof. The air jets (13A) that regulate spray shape and orifice (13) are shown in the figures to indicate the relative position of the delivery device and the air cap when the delivery device is affixed to the air cap. The air jets (13A) and orifice (13) are part of the spray gun.

Figure 5:
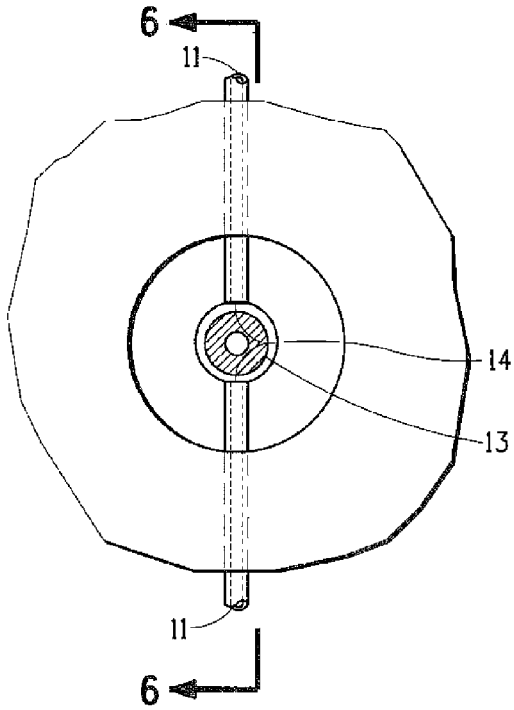
FIG. 5 shows an enlarged frontal view of details of the delivery device and the relative position of the delivery device and the orifice of the spray gun.
Figure 6:
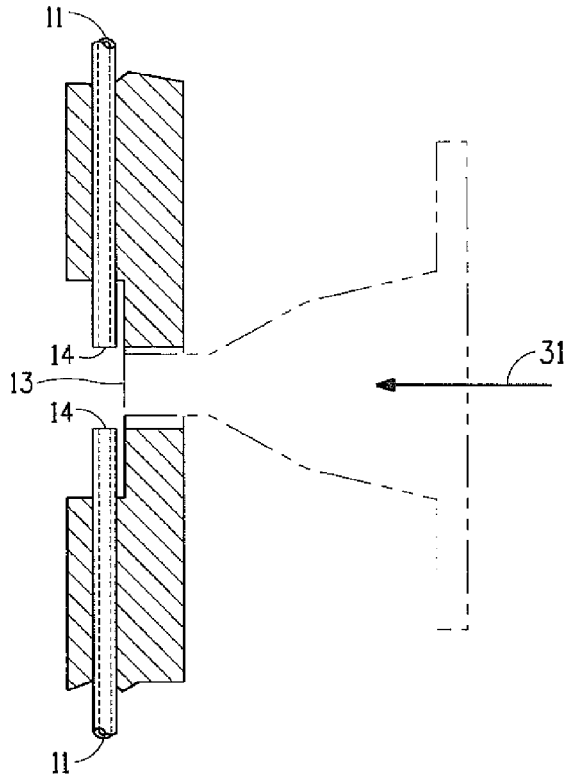
FIG. 6 shows an enlarged side cross sectional view of details of one example of the delivery device and the relative position of the delivery device and the orifice of the spray gun.
Figure 7A:
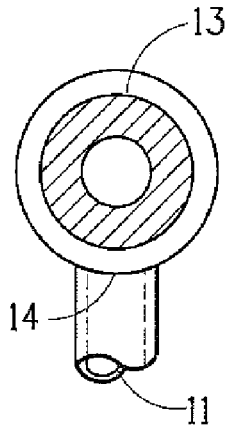
FIG. 7 shows examples of the positional and dimensional relation between an orifice of a spray gun and a delivery outlet of the delivery device of this invention. (A) One example of end opening outline of the delivery outlet that is dimensionally matching a circular outline of an orifice. The outline of the orifice can include the opening in the air cap where the orifice is positioned within. (B) One example of end opening outlines of two delivery outlets that are each dimensionally matching a circular outline of an orifice. (C) Another example of end opening outline of the delivery outlet that is dimensionally matching a second outline of an orifice. (D) Another example of end opening outlines of two delivery outlets that are each dimensionally matching the second outline of an orifice.
Figure 7B:
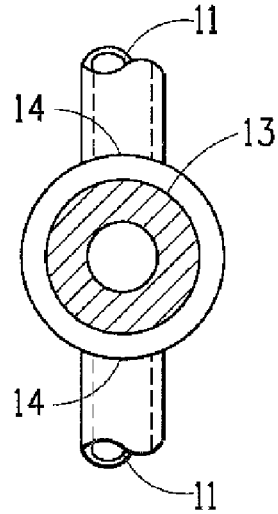
Figure 7C:
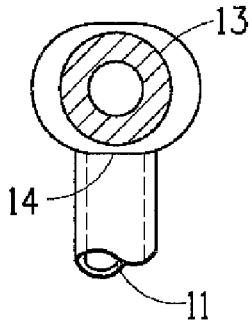
Figure 7D:
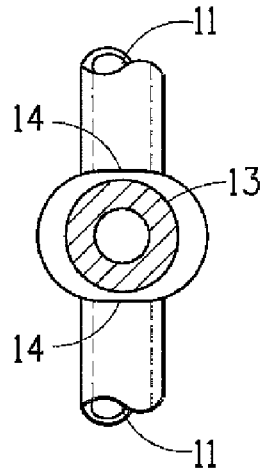

FIG. 5 shows an enlarged frontal view of the orifice (13) and two of the delivery outlets (14). FIG. 6 shows a cross sectional side view of the delivery device indicating the relative position of two of the delivery outlets (14) and the orifice (13) wherein each of the delivery outlets (14) is transversely positioned at said orifice (13). Flow of the first coating component is indicated by the arrow (31). Each of the delivery outlets has an end opening outline that dimensionally matches said orifice. As shown in FIGS. 7A and 7B, when the orifice has a round outline, the end opening outline of the delivery outlet is machined to dimensionally match that round outline of the orifice so the flow of the first coating component from the orifice is not disturbed. When the orifice has a different shape of outline, such as schematically represented in FIGS. 7C and 7D, the end opening of the delivery outlet is machined to dimensionally match that orifice.

Figure 8A:
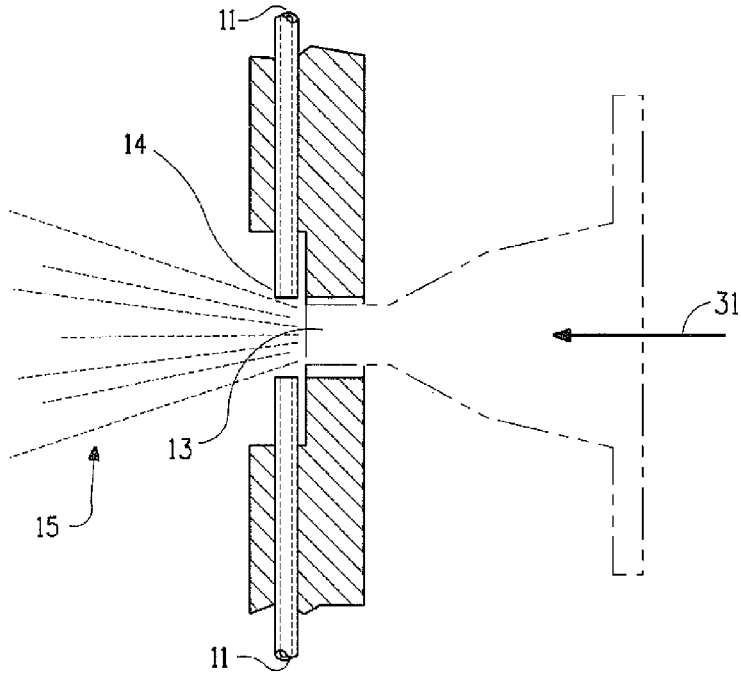
FIG. 8 shows schematic presentations of examples of the formation of a coating mixture. (A) An example of a first coating component that is atomized at an orifice of a spray gun. (B) An example of the coating mixture formed by an atomized first coating component and a second coating component siphoned into the atomized first coating component.
Figure 8B:
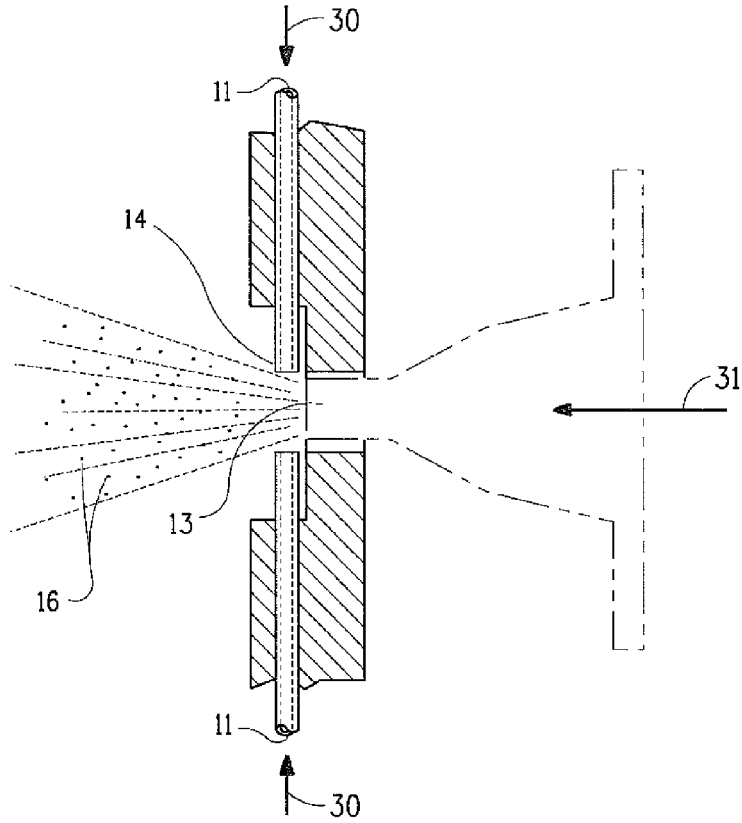
Figure 9A:
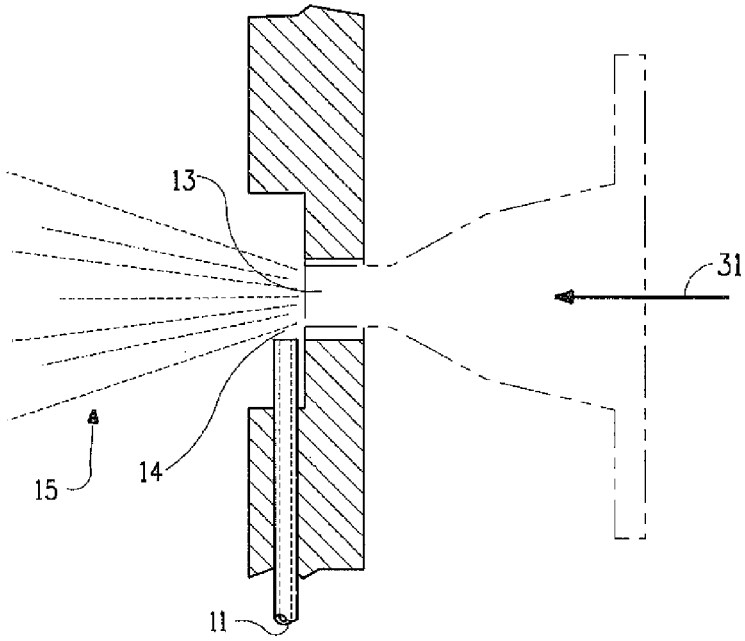
FIG. 9 shows schematic presentations of another example of the formation of a coating mixture. (A) A first coating component atomized at an orifice of a spray gun. (B) A coating mixture formed by an atomized first coating component and a second coating component siphoned into the atomized first coating component.
Figure 9B:
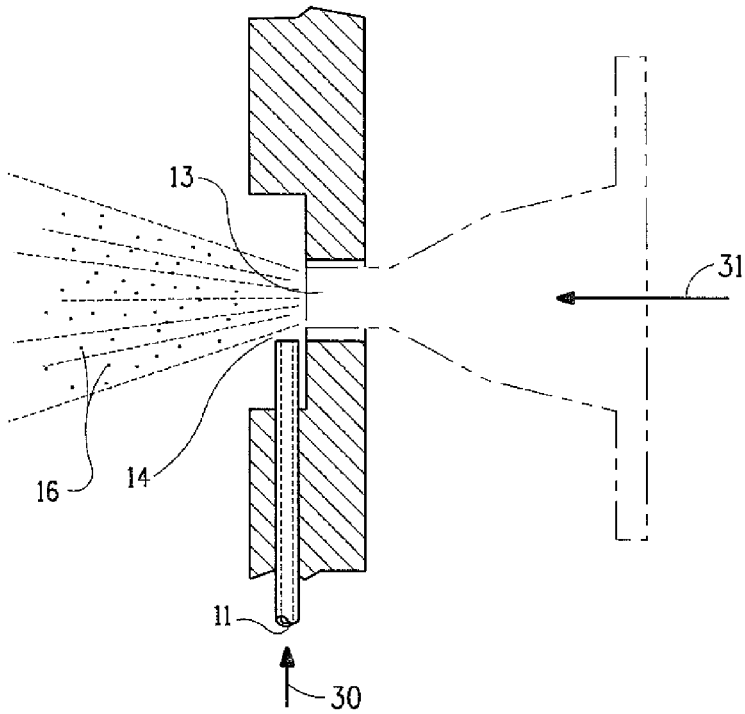

The spray gun can produce a stream (15) of atomized first coating component at the orifice (13) (FIG. 8A). The stream (15) can comprise the atomized first coating component and the fast moving carrier, for example, compressed air. The stream (15) jets away from the orifice at high speed and causes a small area around the orifice being in negative pressure. When the delivery outlet (14) is transversely positioned at said orifice (13) in close proximity, the second coating component can be siphoned by the stream (15) from the delivery outlet (14) into the stream of the atomized first coating component forming a coating mixture (16) (FIG. 8B). Flow of the second coating component that is siphoned by the stream is shown with the arrow (30). FIGS. 9A and 9B show representative examples wherein the delivery device is configured to have only a single delivery outlet (14).

Figure 10A:
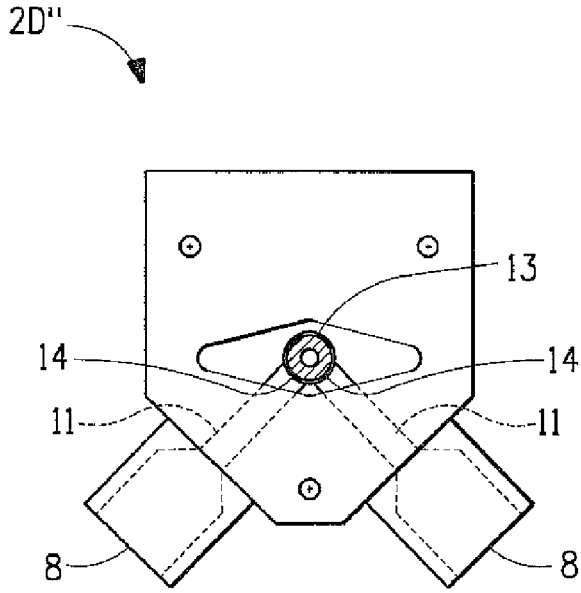
FIG. 10 shows additional examples of the delivery device of this invention constructed as an add-on device. (A) An example of the delivery device that has a configuration of two intake couplings and two delivery outlets. (B) An example of the delivery device that has a configuration of two intake couplings and one common delivery outlet. The orifice (13) is shown in the figure to indicate relative position of the delivery device when affixed to the air cap. The orifice (13) is part of the spray gun.

The system of this invention can be configured to siphon a third or a subsequent component. A delivery device of this invention can be configured to have multiple intake couplings (8), multiple connection paths (11) or multiple delivery outlets (14) as shown in representative examples in FIGS. 4, 10A and 10B. In one representative configuration, both of the delivery outlets can be transversely positioned at the orifice and have end opening outlines that dimensionally matches the orifice (13) (FIGS. 4 and 10A). In another representative configuration, the connection paths can be combined at a point so both connection paths are connected to a single delivery outlet (14), which can be transversely positioned at the orifice and have an end opening outline that dimensionally matches the orifice (13) (FIG. 10B).

The one or more intake couplings (8) can be configured to couple with one or more individual storage containers (4) through direct coupling, such as plug on or screwed on, or via connection means such as fixed or flexible tubing. Additional hardware such as one or more "Y" shaped connectors can also be used. Examples of suitable configurations are shown in FIG. 11: (A) a delivery device having a single intake coupling that is coupled to a single container; (B) a delivery device having a single intake coupling that is coupled to two individual containers; (C) and (F) a delivery device having two intake couplings that only one of them is coupled to a single container, wherein the other intake can be closed; (D) and (G) a delivery device having two intake couplings that both are coupled to a same single container; (E) and (H) a delivery device having two intake couplings that each of them is coupled to separate individual container. When a delivery device has two or more intake couplings and only one of them is coupled to a container, it is preferred to close the uncoupled intake couplings via conventional means, such as a cap, a plug, or a valve. Optionally, one or more flow rate controllers (32), such as a valve, an insert, a clamp, or a commercial inline flow controller can be positioned and configured to control flow rate of one or more components at one or more positions. Those skilled in the art can design or modify configurations based on descriptions of this invention disclosed herein.

Figure 10B:
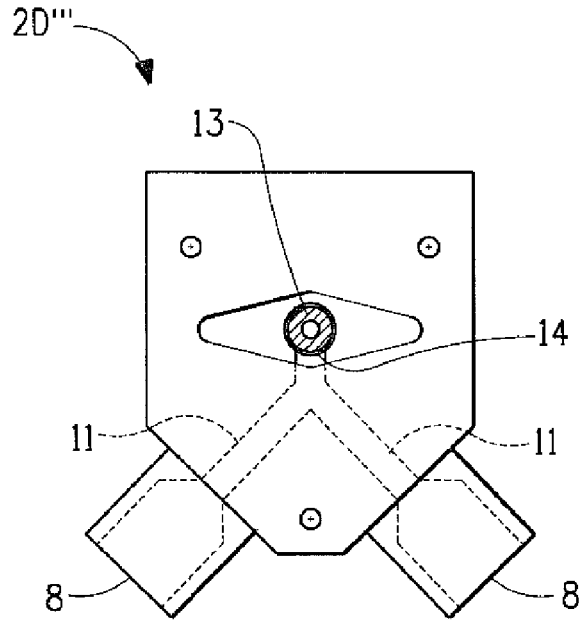
Figure 11A:
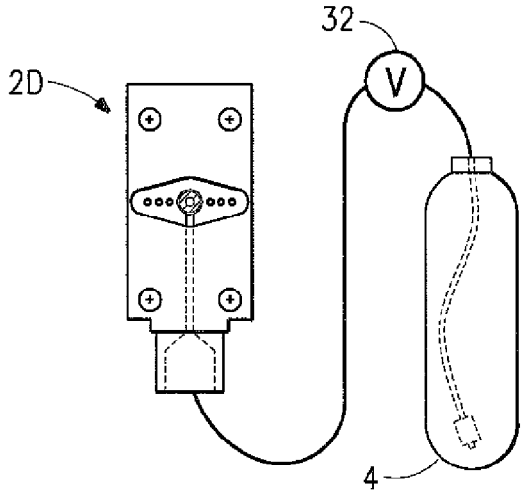
FIG. 11 shows schematic presentations of different configurations of the delivery device of this invention. (A) An example of a delivery device having one intake coupling that is coupled to one storage container. (B) An example of a delivery device having one intake coupling that is coupled to two individual storage containers. (C) An example of a delivery device having two intake couplings that only of the two is coupled to one storage container. (D) An example of a delivery device having two intake couplings that both are coupled to a single storage container. (E) An example of a delivery device having two intake couplings that each is coupled to an individual storage container. (F) Another example of a delivery device having two intake couplings that only one of the two is coupled to a single storage container. (G) Another example of a delivery device having two intake couplings that both are coupled to a single storage container. (H) Another example of a delivery device having two intake couplings that each is coupled to an individual storage container. The schematic representations are for illustration purposes only and items in the presentations may not be to scale. The air jets (13A) or the orifice (13) are shown in the figures to indicate relative position of the delivery device when affixed to the air cap. The air jets (13A) and orifice (13) are part of the spray gun.
Figure 11B:
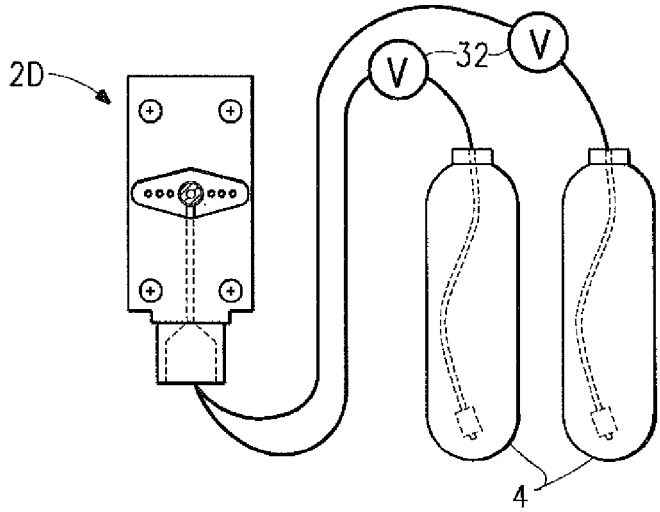
Figure 11C:
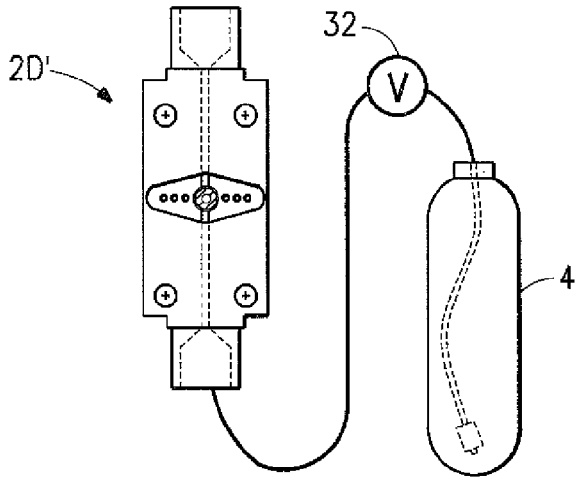
Figure 11D:
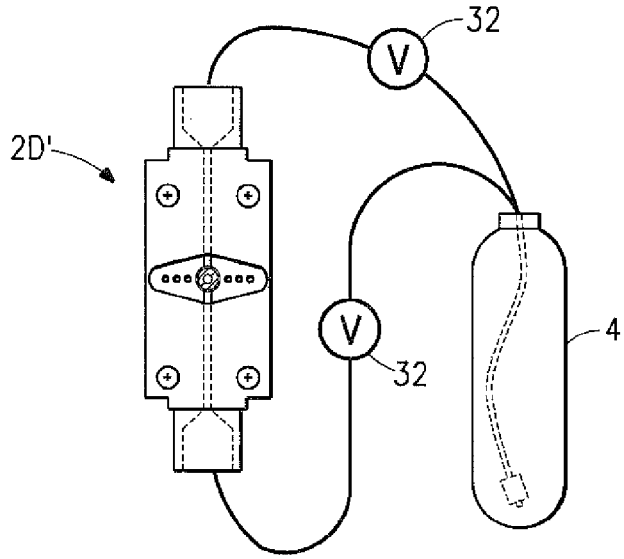
Figure 11E:
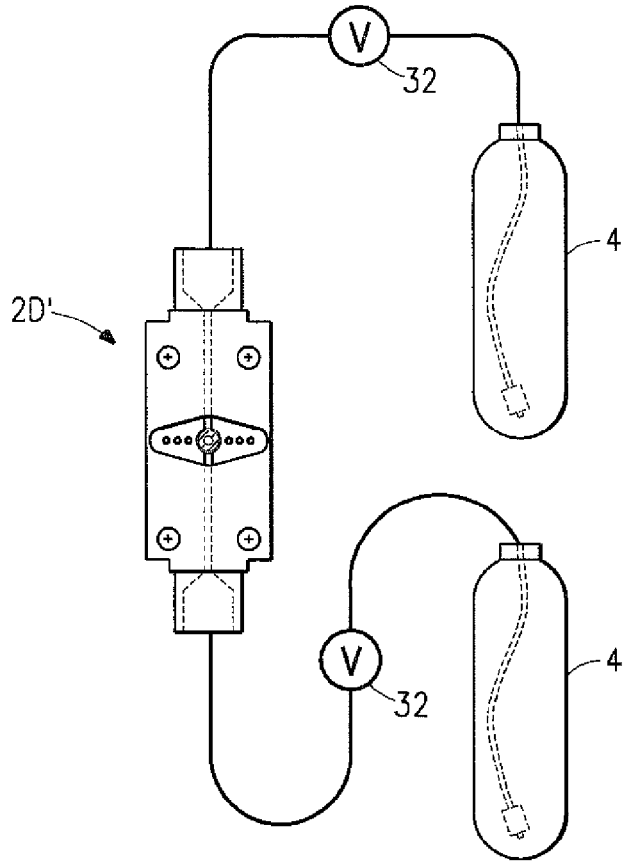
Figure 11F:
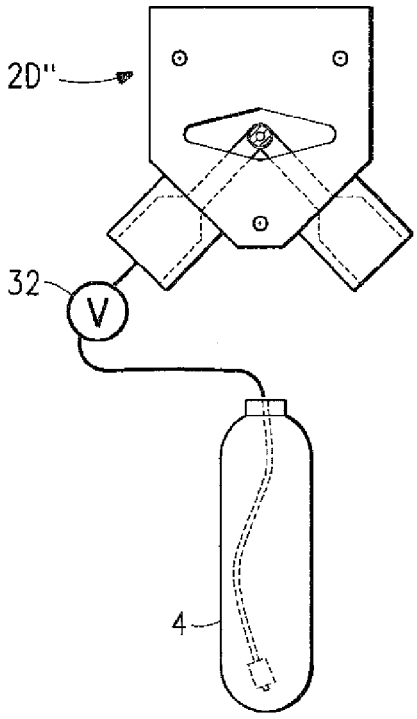
Figure 11G:
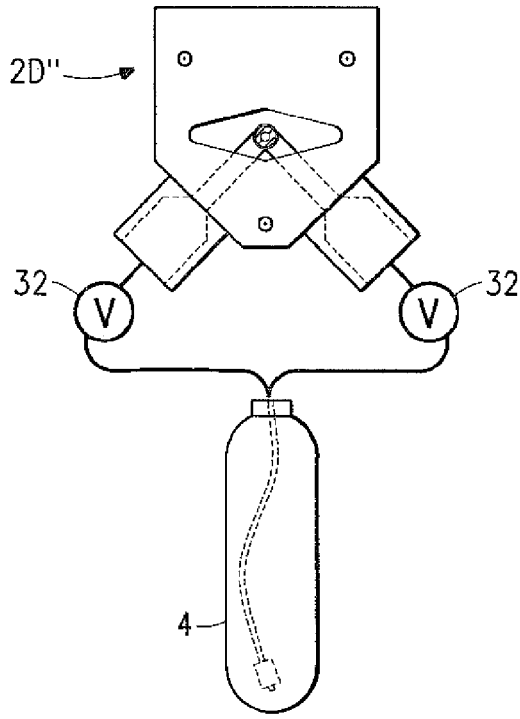
Figure 11H:
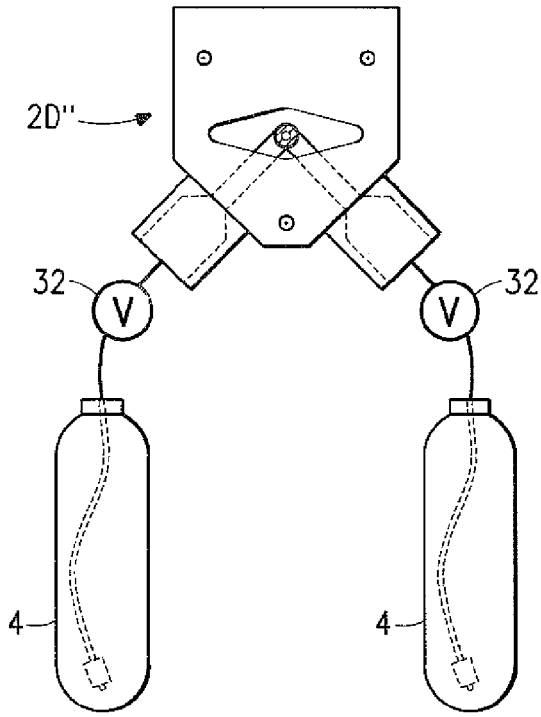

The delivery device exemplified in FIG. 10B can also be configured to be coupled to one or more containers in a way similar to that is shown in FIGS. 11F, 11G and 11H.

Although coating compositions with multiple coating components are specifically described here, this invention can also be used for a composition having multiple components that need to be mixed to form a mixed composition. With this invention, a first component of the composition can be atomized by a spray device and a second or a subsequent component of the composition can be siphoned into the atomized first component to form the mixed composition.

This invention can also be directed to a system for producing a mixed composition comprising two or more components. Said system comprises:

(A) a spray device for producing a stream of atomized first component of said mixture composition through an orifice of said spray device; and (B) a delivery device for delivering one or more additional components of said mixed composition into the stream of atomized said first component, said delivery device comprises:

(a) at least one delivery outlet (14);

(b) at least one intake coupling (8); and (c) at least one connection path (11) connecting said intake coupling and said delivery outlet;

wherein said one or more additional components are siphoned by said stream of atomized said first component from said delivery outlet;

wherein said delivery outlet is coupled through said connection path and said intake coupling to one or more storage containers containing said one or more additional components; and wherein said delivery outlet being transversely positioned at said orifice and having an end opening outline that dimensionally matches said orifice.

In the system described above, said stream of atomized first component can be produced by a compressed carrier selected from compressed air, compressed gas, compressed gas mixture, or a combination thereof.

EXAMPLES

The present invention is further defined in the following Examples. It should be understood that these Examples, while indicating preferred embodiments of the invention, are given by way of illustration only. From the above discussion and these Examples, one skilled in the art can ascertain the essential characteristics of this invention, and without departing from the spirit and scope thereof, can make various changes and modifications of the invention to adapt it to various uses and conditions.

Viscosity can be determined by using Zahn cup #2 viscosity measurements in second. Pot life in following examples is defined by the length of time required to double viscosity of the coating composition or the relevant pot mix.

Hardness measurement can be performed by using either Persoz machine available as GARDCO® Pendulum Hardness Tester, Model HA-5854, manufactured by BYK Chemie, Germany and sold by Paul N. Gardness Company, Inc. Pompano Beach, Fla. Persoz hardness is used when expected hardness value is between 0 and 250 seconds. The higher the hardness value, the harder is the coating film.

Viscosity Measurement

A clearcoat ChromaClear® G2-4700S™, available from E.I. du Pont Nemours and Company, Wilmington, Del., was used. ChromaClear® and G2-4700S™ are trademarks of E.I. du Pont Nemours and Company, Wilmington, Del. G2-4700S™ requires an activator and a catalyst to form a coating. The activator used was G2-4509S™, also available from E.I. du Pont under respective trademark. The catalyst used was Fascat® 4202 dibutyl tin dilaurate available from Arkema, Bristol, Pa., under respective trademark.

When the clearcoat G2-4700S was mixed with the activator G2-4509S and the catalyst Fascat® 4202 to form a pot mix according to manufacturer's instruction, viscosity of the pot mix increased rapidly leading to a limited pot life of the pot mix: at 120 minutes after mixing, viscosity had doubled comparing to time zero (Table 1). When the clearcoat G2-4700S was mixed with the activator G2-4509S, without the catalyst, viscosity remained constant for long period of time. Viscosity measurement data are shown in Table 1.

TABLE 1

Viscosity Zahn #2 (Measurement Unit: Second).

| Time (Minute) | G2-4700S/G2-4509S with catalyst mixed | G2-4700S/G2-4509S without catalyst |
|---|---|---|
| 0 | 18.0 | 18.3 |
| 15 | 20.2 | 19.1 |
| 30 | 21.2 | 19.2 |
| 45 | 22.0 | 19.2 |
| 60 | 23.2 | 19.3 |
| 75 | 25.0 | 19.4 |
| 90 | 28.5 | 19.5 |
| 105 | 32.1 | 19.6 |
| 120 | 47.5 | 19.6 |
| 135 | | 20.0 |
| 150 | | 20.0 |
| 165 | | 20.0 |
| 180 | | 20.0 |
| 210 | | 20.5 |

TABLE 1-continued

| Viscosity Zahn #2 (Measurement Unit: Second). | | |
|---|---|---|
| Time (Minute) | G2-4700S/G2-4509S with catalyst mixed | G2-4700S/G2-4509S without catalyst |
| 240 | | 20.5 |
| 270 | | 20.6 |
| 300 | | 20.6 |
| 330 | | 20.7 |
| 360 | | 20.9 |
| 390 | | 21.0 |
| 420 | | 21.0 |
| 450 | | 22.1 |

Atomizing Air Pressure and Mixing Ratio

Mixing ratio of the aforementioned clearcoat G2-4700S/G2-4509S and the catalyst Fascat® 4202 was measured at different atomizing air pressures using the delivery device of this invention. The air pressure was adjusted to the indicated air pressures by using the air pressure regulator assembly (25). In one set of experiments, an insert was placed inside the tubing that was connected to the intake coupling (8) and used as a flow rate controller to reduce the flow of the catalyst from the container (4). As shown in Table 2, mixing ratios were relatively constant at a wide range of air pressures, ranging from 30-60 pounds per square inch gauge (psig).

Mixing ratio is shown as a ratio between the weight of the paint (G2-4700S and G2-4509S Mix) and the weight of the catalyst Fascat® 4202. Both weights are shown in grams.

TABLE 2

| Atomizing air pressure and mixing ratio. | | | |
|---|---|---|---|
| Atomizing Air Pressure (psig) | Paint Flow (G2-4700S & G2-4509S Mix) (Gram) | Catalyst Flow (Fascat ® 4202) (Gram) | Mixing Ratio (Paint/Catalyst) |
| Without Flow rate Controller | | | |
| 20 | 190 | 10 | 19.0 |
| 30 | 50 | 10 | 5.0 |
| 40 | 40 | 10 | 4.0 |
| 50 | 40 | 10 | 4.0 |
| 60 | 40 | 10 | 4.0 |
| With Flow Rate Controller | | | |
| 20 | 180 | 10 | 18.0 |
| 30 | 80 | 10 | 8.0 |
| 40 | 80 | 10 | 8.0 |
| 50 | 85 | 11 | 7.7 |
| 60 | 85 | 11 | 7.7 |

Hardness of the Coatings

A gravity-feed spray gun available from Sharpe Platinum, Graco Inc., Minneapolis, Minn., was used for spraying the control and the experiment clearcoats.

For controls, the clearcoat ChromaClear® G2-4700S, the activator G2-4700S, and the catalyst Fascat® 4202 solutions were mixed to form a pot mix. The pot mix was loaded into the main reservoir of the spray gun.

For Experiment, the clearcoat ChromaClear® G2-4700S™ and the activator G2-4700S was mixed and loaded into the main reservoir of the. The catalyst Fascat® 4202 solution was loaded into the storage container for the second coating component attached to the delivery device shown in FIG. 3. A flexible container that can be easily collapsed was used for the catalyst solution. A unidirectional flow limiter was attached to the end of a supply tube inside the container to eliminate back flow.

Atomizing air pressures for spraying both the Experiment and the control clearcoats were adjusted to be at 30 psig. Conventional 12"×18" coil coated aluminum test panels available from ACT Laboratories of Hillsdale, Mich., were used as substrates. The Experiment and the control clearcoats were sprayed separately onto separate test panels using conventional spray technique. The coated panels were cured at room temperature. Hardness of the clearcoats was measured at indicated time points.

Hardness data are shown in Table 3. Both Experiment and control clearcoats showed similar hardness at the testing points indicated. The Experiment clearcoats had slightly increased hardness at 4 hour and 24 hour points.

TABLE 3

| Coating Persoz hardness (Seconds). | | | |
|---|---|---|---|
| | 2 Hours | 4 Hours | 24 Hours |
| Control Clearcoat | 17 | 24 | 87 |
| Experiment Clearcoat | 17 | 28 | 119 |

What is claimed is:

1. A system for producing a layer of a coating composition on a substrate, said system comprising:

(A) a spray gun for producing a stream of atomized first coating component of said coating composition through an orifice of said spray gun, said spray gun comprises a spray gun body (1), one or more inlets, a nozzle assembly including an orifice (13) and an air cap (24); and (B) a delivery device for delivering at least one additional coating component into the stream of atomized said first coating component, said delivery device comprises:

(a) at least one delivery outlet (14);

(b) at least one intake coupling (8); and (c) at least one connection path (11) connecting said intake coupling and said delivery outlet;

wherein said additional coating component is siphoned by said stream of atomized said first coating component from said delivery outlet;

wherein said delivery outlet is coupled through said connection path and said intake coupling to a storage container (4) containing said additional component; and wherein said delivery outlet being transversely positioned at said orifice and having an end opening outline that dimensionally matches said orifice.

2. The system of claim 1, wherein said delivery outlet, said intake coupling, and said connection path are constructed as an add-on device affixed to the air cap of said spray gun.

3. The system of claim 1, wherein said delivery outlet, said intake coupling, and said connection path are constructed into the air cap of said spray gun.

4. The system of claim 1, wherein said delivery device comprises two or more delivery outlets.

5. The system of claim 1, wherein said delivery device comprises two or more intake couplings.

6. A system for producing a mixed composition comprising two or more components, said system comprising:

(A) a spray device for producing a stream of atomized first component of said mixture composition through an orifice of said spray device; and (B) a delivery device for delivering one or more additional components of said mixed composition into the stream of atomized said first component, said delivery device comprises:

(a) at least one delivery outlet (14);

(b) at least one intake coupling (8); and (c) at least one connection path (11) connecting said intake coupling and said delivery outlet;

wherein said one or more additional components are siphoned by said stream of atomized said first component from said delivery outlet;

wherein said at least one delivery outlet is coupled through said connection path and said intake coupling to one or more storage containers (4) containing said one or more additional components; and wherein said delivery outlet being transversely positioned at said orifice and having an end opening outline that dimensionally matches said orifice.

7. The system of claim 6, wherein said stream of atomized first component is produced by a compressed carrier selected from compressed air, compressed gas, compressed gas mixture, or a combination thereof.

* * * * *